United States Patent [19]

Goodrich et al.

[11] 4,134,445

[45] Jan. 16, 1979

[54] CENTRIFUGAL CASTING APPARATUS

[75] Inventors: William F. Goodrich, Galesburg, Ill.; Robert C. Ingersoll, Adrian, Mich.; Donald W. Doman, Janesville, Wis.

[73] Assignee: Dick Blick Company, Galesburg, Ill.

[21] Appl. No.: 822,200

[22] Filed: Aug. 5, 1977

[51] Int. Cl.[2] ..... B22D 13/00

[52] U.S. Cl. ..... 164/287; 164/286; 164/289; 233/26

[58] Field of Search ..... 164/113–117, 164/286–290, 298; 233/26; 210/360 R

[56] References Cited

U.S. PATENT DOCUMENTS

| | | | |
|---|---|---|---|
| 2,297,973 | 10/1942 | Moore | 164/289 |
| 2,361,906 | 11/1944 | Anderson | 164/152 |
| 2,749,585 | 6/1956 | Prosen | 164/287 |

*Primary Examiner*—Francis S. Husar

*Assistant Examiner*—K. Y. Lin

*Attorney, Agent, or Firm*—Harry O. Ernsberger

[57] ABSTRACT

The disclosure embraces a centrifugal casting apparatus of a character for casting comparatively small articles or objects of highly refractory metals, such as jewelry and similar articles, the centrifugal casting apparatus being enclosed in a housing, the arrangement having a motor-driven throwing arm and a secondary arm mounting components of the casting apparatus, the secondary arm being adapted upon energization of the motor to be centrifugally oscillated or rotated about a pivot axis to a diametrically aligned position with the throwing arm to rapidly accelerate flow of the molten casting metal into the mold, the apparatus including a closure or cover for the housing in association with means for automatically interrupting operation of the motor when the cover or closure is moved to an open position.

4 Claims, 7 Drawing Figures

CENTRIFUGAL CASTING APPARATUS

This invention relates to improvements in centrifugal casting apparatus wherein molds are utilized formed by the so-called "lost wax" process and wherein an electrically energizable motor is employed for rotating the casting apparatus whereby centrifugal force is provided to effect flow of molten metal into a mold, the arrangement including a housing and cover means for protection of the operator. Centrifugal devices have heretofore been used for effecting flow of molten metal into a mold formed by the "lost wax" method. Such prior devices have embodied a shaft carrying a throwing arm to which is pivoted an extension or mold carrying device.

In such devices, the force for rotating the throwing arm is provided by a coil spring which is wound up by manual rotation of the throwing arm and, after molten metal is inserted in a crucible adjacent the mold, the spring is manually released and rotates the throwing arm which causes the mold carrying device to be thrown outwardly for causing the molten metal from a crucible to flow into the mold. An example of such construction is shown in the U.S. Re. Pat. No. 17,783 to Gardner et al.

Such prior devices presented many hazards which could endanger the operator and under certain conditions such devices were ineffective to secure proper molding or casting. In the use of such prior devices, the throwing arm had to be manually rotated to wind up the spring and, if the arm were released inadvertently before an arm locking member was moved to locking position the force of the spring would rotate the arm thus endangering the operator.

Furthermore, there was a tendency during certain types of molding operation for the hot metal to be splashed from the crucible which could inflict burns upon the operator. Another difficulty encountered with such prior devices is that momentum of the rotating apparatus was relied upon for completion of the molding operation after the force of the wound-up spring was expended and, in many instances, the momentum of the rotating arm was insufficient to cause the molten metal to fill the mold.

The invention embraces a centrifugal casting apparatus wherein the rotative components of the apparatus are enclosed or surrounded by a housing construction and the components rotated by an electrically energizable motor to effectively influence the molten casting metal to flow into and completely fill a casting mold.

Another object of the invention resides in a centrifugal casting apparatus wherein rotative components of the apparatus are enclosed or surrounded by a housing and wherein the apparatus includes support means for the housing to enclose an electrically energizable motor for rotating the components.

Another object of the invention resides in a centrifugal casting apparatus adapted to be rotated by an electrically energizable motor, the apparatus including a throwing arm and a secondary arm, the latter mounting the casting components pivoted to the throwing arm in a manner whereby the secondary arm and casting components are normally maintained in a position substantially at a right angle to the longitudinal axis of the throwing arm whereby initial rotation of the throwing arm by the motor causes the secondary arm and the casting components to be rapidly swung or moved outwardly to a position in diametrical alignment with the throwing arm, the initial swinging movement of the secondary arm about its pivotal axis effectively accelerating flow of molten metal from a crucible into the mold carried by the secondary arm.

Another object of the invention resides in a centrifugal casting apparatus wherein the throwing arm is equipped with adjustable balancing means for substantially counterbalancing the mass comprising the secondary arm and casting components when the same are in diametrically aligned relation with the longitudinal axis of the throwing arm.

A further object of the invention resides in the provision of a relatively movable cover for the housing enclosing the centrifugal casting apparatus and including means associated with the cover for automatically deenergizing or interrupting operation of the motor when the cover is moved away from the closed position.

Another object of the invention is the provision of balancing means mounted by the throwing arm comprising weights or bodies which may be varied in number and are adjustable lengthwise of the throwing arm to effectively counterbalance the weight or mass of the casting components and the secondary arm and the molten metal contained in a crucible.

Further objects and advantages are within the scope of this invention such as relate to the arrangement, method of operation and function of the related elements, to various details of construction and to combinations of parts, elements per se, and to economies of manufacture and numerous other features as will be apparent from a consideration of the specification and drawing of a form of the invention, which may be preferred, in which.

Figure 1:
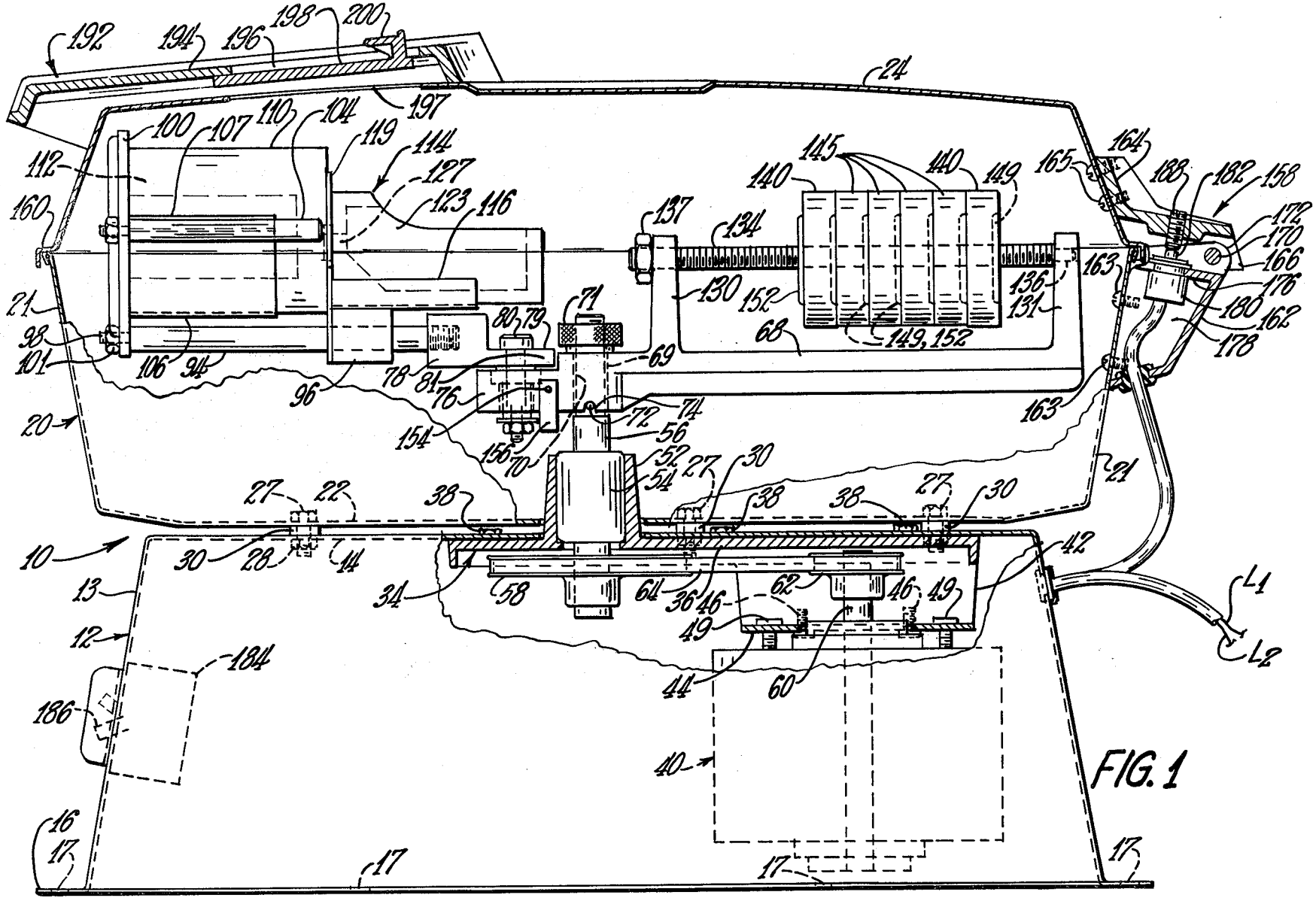
FIG. 1 is a side elevational view, partly in section, of the centrifugal casting apparatus of the invention.

Referring to the drawings in detail and initially to FIG. 1, the centrifugal casting machine or apparatus includes a frame or housing construction 10 which comprises a support means, frame member or lower component 12 and a housing member or upper component 20, the latter surrounding or enclosing the centrifugal casting apparatus. The support means, frame member or lower component 12 in the embodiment illustrated is of sheet metal and is preferably formed with an outer wall 13 of frusto-conically shaped configuration and a plate or planar portion 14 which is integral with the wall 13.

The lower component, support means or frame member 12 is also referred to herein as a housing as it encloses the motor for operating the centrifugal casting apparatus. The support means 12 may be of a different configuration if desired. The lower end of the frame or support means 12 terminates in an outwardly extending flange 16 which is provided with circumferentially spaced openings 17 for accommodating screws (not shown) for securing or anchoring the support means or frame member 12 to a table surface or other suitable support.

Figures 3, 7:
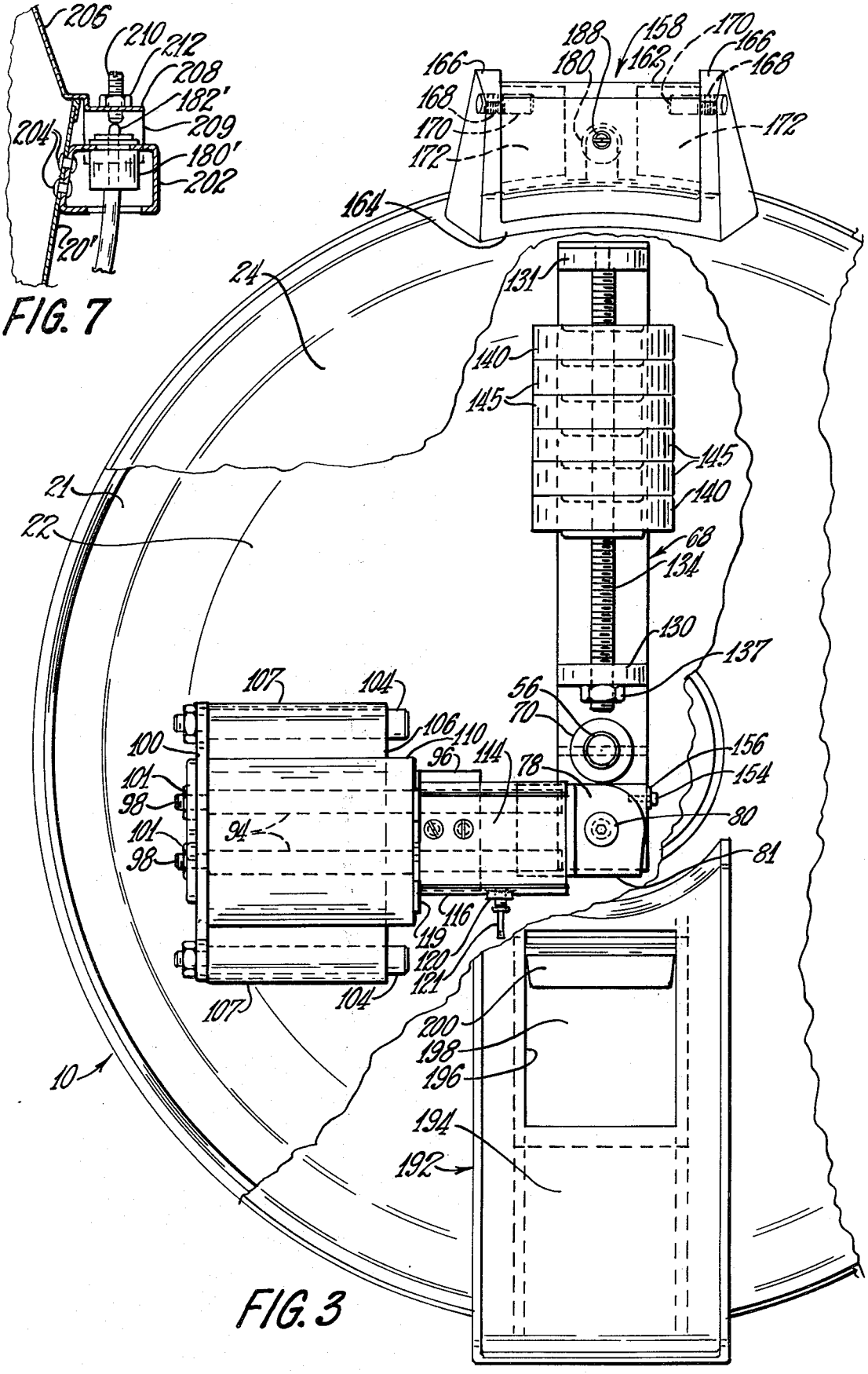
FIG. 3 is a top plan view similar to FIG. 2 showing rotatable components of the centrifugal apparatus in a modified position.
FIG. 7 is a fragmentary detail view of a modification of a housing closure.

Mounted upon the support means or member 12 is the housing or member 20 which is preferably fashioned of sheet metal. The housing or upper component 20 is fashioned with a frusto-conically shaped outer wall 21 and a horizontal plate or planar portion 22 integrally joined with the outer wall 21. The housing 20 is preferably provided with a relatively movable, thin-walled metal cover 24 which, in the embodiment illustrated in FIGS. 1 and 3, is articulately joined with or hinged to the housing 20 in a manner hereinafter described.

As shown in FIG. 1, the plate or planar portions 14 and 22 of the respective components or members 12 and 20 are in substantially parallel relation and slightly spaced apart as illustrated in FIG. 1. The plate portions 14 and 22 are provided with a plurality of spaced registering openings which receive bolts 27, each of which receives a securing nut 28. Each of the bolts 27 receives a spacer or washer 30 for spacing the plate portions 14 and 22 of the housings as illustrated in FIG. 1.

The washers or spacers 30 may be of metal but are preferably fashioned of semirigid rubber or plastic to minimize transmission of vibrations of one housing component to the other. Disposed contiguous with the plate portion 14 of the housing member 12 is a supplemental frame or member 34, a planar portion 36 of the frame member 34 being secured to the housing construction by means of bolts 38. The supplemental frame or member 34 provides a support or mounting for an electrically energizable motor 40 which drives rotatable components of the centrifugal casting apparatus hereinafter described.

The supplemental frame member 34 is formed with two spaced parallel depending portions 42 which provide support for a motor mounting plate or member 44. The depending portions 42 are provided with threaded openings to receive bolts 46 which extend through elongated slots 47 in the motor mounting plate 44. The slots 47 provide for adjustment of the motor 40 in the direction of the elongation of the slots 47. Bolts 49 extend through openings in the motor mounting plate 44 and are threaded into the motor housing for securing the motor 40 to the mounting plate 44.

The supplemental frame member 34 is fashioned with an upwardly extending hollow boss portion 52 in which is snugly fitted a bearing housing 54 which encloses antifriction bearing means (not shown) of conventional construction. Journaled in the bearing means contained within the housing 54 is a shaft 56 upon which is supported the rotatable components of the centrifugal casting apparatus.

The shaft 56 extends through an opening in the supplemental frame or member 34 and is equipped with a drive sheave or pulley 58. The shaft 60 of the motor 40 is equipped with a driving sheave or pulley 62. An endless belt 64 engages the sheaves 58 and 62 whereby the shaft 56 is driven by the motor 40.

Certain rotatable components of the centrifugal casting apparatus are pivotally mounted for movement about an axis spaced from the axis of the shaft 56 whereby such components are rapidly moved by centrifugal forces through an initial tangential motion to promote rapid flow of molten metal from a crucible into a mold in a flask to effectively fill the mold with the molten metal.

A throwing arm or primary member 68 is mounted on the motor driven shaft 56. The arm 68 is provided with an opening or bore 69 to receive an upper threaded portion 70 of the shaft 56 which accommodates a knurled securing nut 71. The shaft 56 is provided with a transversely extending pin 72 which is received in a recess or notch 74 in the arm or member 68 thus assuring a positive drive between the shaft 56 and the arm 68.

The bore 69 is of larger diameter than the threaded portion 70 of the shaft 56 so as to provide limited tilting of the throwing arm 68 about the pin 72 as a fulcrum to facilitate balancing the rotatable components of the apparatus as hereinafter described.

The arm or member 68 has an extending portion 76 to which is pivoted a secondary arm or member 78. The secondary arm or member 78 is provided with a ledge 79, the ledge being drilled to accommodate a headed pivot pin 80. The extending portion 76, which is adjacent the ledge 79, is provided with a bore accommodating a guide sleeve 82, the pin 80 extending through the guide sleeve.

The portion 76 of the arm 68 is fashioned with a recess accommodating a ball bearing 84 to minimize the friction of rotation of the pin 80 with respect to the extending portion 76. The pin is secured in the extending portion 76 and ledge 79 by a nut 86 received on a threaded portion 87 of the pin or shaft 80.

Figure 4:
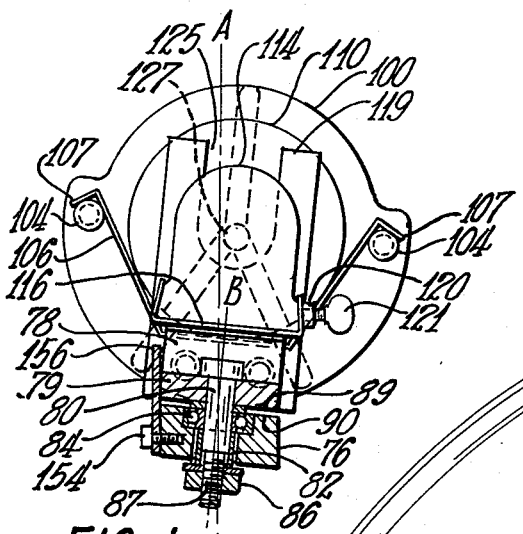
FIG. 4 is a sectional view taken substantially on the line 4—4 of FIG. 2.

As will be seen from FIG. 4, the axis of the pin 80 is at an angle with respect to a vertical line A—A and the surface 89 of the ledge 79 of the secondary arm 78 is at an angle or is askew with respect to the vertical axis A—A, the upper surface 90 of the portion 76 being in parallelism with the surface 89.

As the pin 80 is mounted in antifriction or ball bearings 84, the effect of the askew or angular ramp surfaces 89 and 90 and the inclination of the axis of the pin 80 to a vertical axis A—A is to cause the secondary arm 78 and components carried thereby to freely swing or rotate to a position normal to or at a right angle to the lengthwise axis of the primary arm 68 as illustrated in FIG. 3. The angularity C of the axis B—B of the pin 80 with respect to the vertical axis A—A as indicated on FIG. 4 is in an range of about two degrees and ten degrees and is preferably about five degrees.

In effect, the secondary arm 78 and components carried thereby are normally biased to a tangential position with respect to the shaft 56. The purpose of positioning the secondary arm 78 and components mounted thereby in a right angle position with respect to the longitudinal axis of the primary arm or member 68 will be hereinafter explained.

The secondary arm or member 78 provides mounting means for casting components which include a flask, flask supporting means, a flask plate and a crucible for containing molten metal in carrying out casting operations. The secondary arm or member 78 is provided with threaded openings to receive the threaded ends of support bars 94 upon which is mounted a crucible carriage 96 for slidable movement along the bars 94. The opposite end regions of the bars 94 are provided with threaded tenons 98 which extend through openings in a flask plate 100, the flask plate being secured to the bars by nuts 101 on the tenons 98.

Secured to the flask plate 100 are cradle supporting pins or members 104. Mounted upon the members 104 is a cradle 106 fashioned of sheet metal having edge portions 107 engaging the cradle supporting pins 104. The cradle 106 is arranged to support a molding flask 110 which, in the embodiment illustrated, is of cylindrical configuration preferably fashioned of sheet metal. The flask 110 is adapted to contain a mold 112 which is of investment, plaster of Paris, or the like, containing the mold configuration of the item to be molded of metal by the centrifugal casting apparatus.

The slidably mounted carriage 96 provides support for a crucible 114 of high temperature resistant refractory or like material. Secured to the carriage 96 is a crucible holder 116. Also secured to the carriage 96 is a crucible plate 119 which abuts the rear end surface of the crucible 114. As shown in FIG. 4, the crucible holder 116 is fashioned with a threaded boss 120 which accommodates a winged bolt 121 for securing the crucible 114 in the holder 116.

The crucible 114 is fashioned with a chamber 123 to accommodate metal for molding configurations in the mold contained in the flask 110. The crucible plate 119 is provided with a slot 125 as shown in FIG. 4. The rear wall of the crucible is provided with a passage or opening 127 through which molten metal from the crucible chamber 123 flows through the slot 125 into the mold in the flask 110.

Means is provided associated with the throwing arm or member 68 for substantially counterbalancing the weight or mass of the secondary arm 78 and casting components carried thereby including the casting metal which is contained in the crucible chamber 123 preparatory to a casting operation. In the embodiment illustrated, the throwing arm or member 68 is provided with lengthwise-spaced upwardly extending portions or projections 130 and 131. The projection or portion 130 is provided with a threaded bore which receives a threaded member or shaft 134. An end of the shaft 134 is provided with a tenon portion 136 which is received in a bore in the projection 131. The threaded shaft or member 134 is securely locked in position by a locking nut 137.

Figure 5:
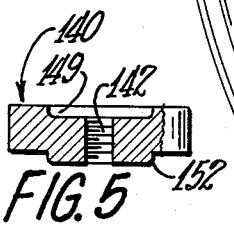
FIG. 5 is an elevational view, partly in section, of one of the primary balancing weights for the centrifugal apparatus.

The threaded shaft or member 134 supports weights or bodies as a counterbalancing means for the casting components and the secondary arm or member 78. In the embodiment illustrated, a plurality of adjustable weights or bodies is utilized as counterbalancing means. The end weights 140, one of which is shown in detail in FIG. 5, are provided with threaded openings 142, these weights being in threaded engagement with the threaded shaft 134.

Figure 6:
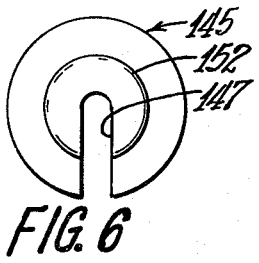
FIG. 6 is a plan view of one of the supplemental balancing weights.
Figure 2:
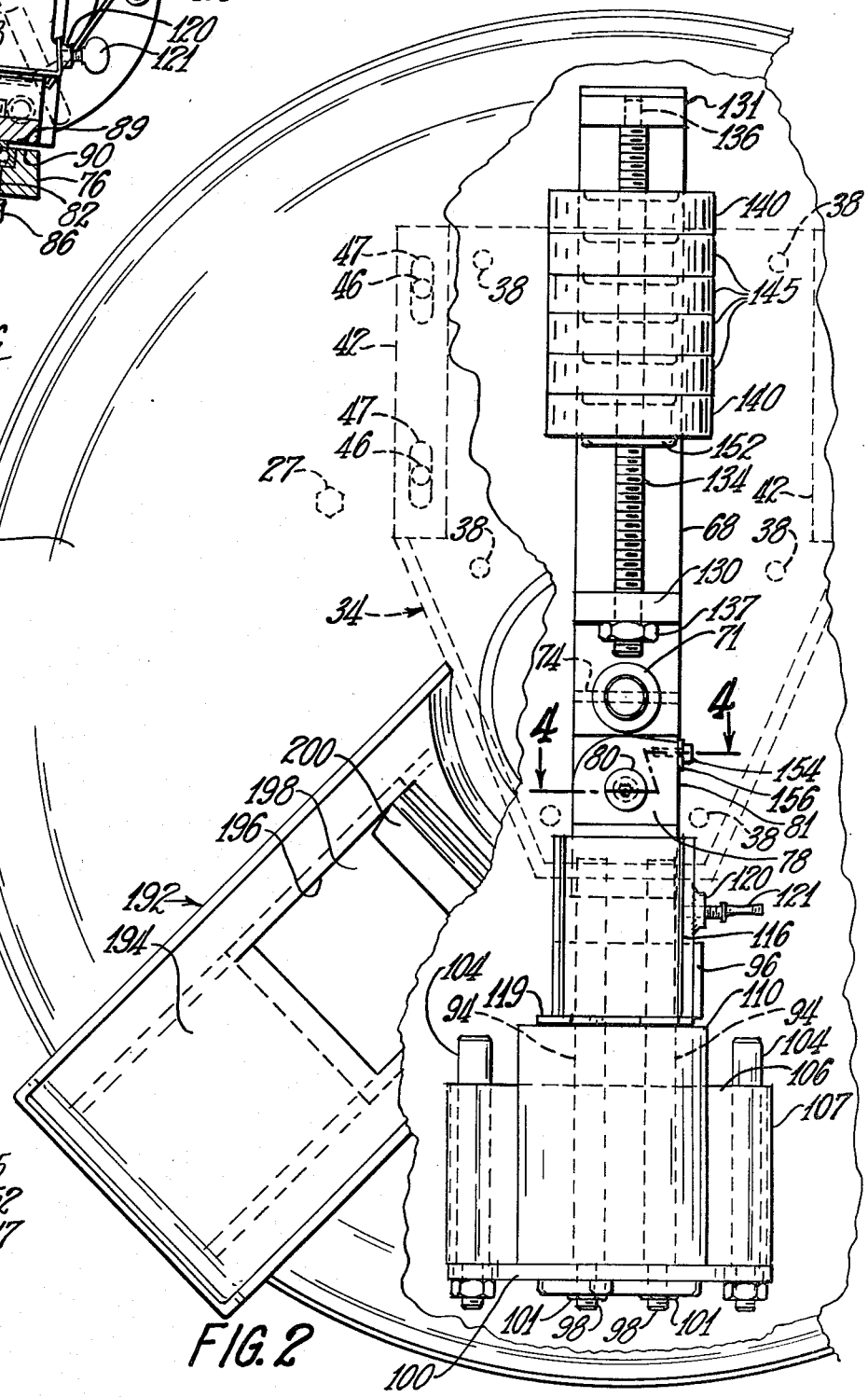
FIG. 2 is a top plan view of the arrangement shown in FIG. 1 with part of the cover broken away for purposes of illustration.

In the embodiment illustrated, supplemental weights 145, one of which is shown in FIG. 6, are provided with radial slots 147 so that the weights 145 may be received on the shaft 134 by transverse movement. Each of the weights 140 and 145 is fashioned on one face with a circular recess 149, and the opposite face of each weight provided with a circular raised portion or ridge 152 as shown in FIG. 5. When the weights are assembled on the shaft 134, as shown in FIGS. 1, 2 and 3, each circular recess 149 accommodates the raised circular ridge 152 on the adjacent weight.

The end weights 140 are rotated into contiguous locking engagement with the adjacent weights 145 and the ridges 152 interengaging the recesses 149 securely hold the supplemental weights 145 in assembled relation thus preventing their dislodgment when the arms or members 68 and 76 and associated components are rotated by the motor 40 in the performance of casting operations.

It is to be understood that while several supplemental weights 145 may be assembled on the shaft 134 between end weights 140 as a counterbalancing means, the number of weights may be increased or decreased depending upon the amount of metal contained in the crucible 123. In certain casting operations where only a small amount of metal is used, the weights 140, which are threaded on the shaft 134, may be sufficient as a counterbalancing means.

As both weights 140 are threaded on the shaft 134, these weights when drawn into engagement with each other or with the supplemental weights 145 provide a locking means for locking the weights in a fixed position on the arm 68. It is to be understood that a wide range of adjustment of the weights is provided through the provision of the threaded shaft 134 as the number of supplemental weights may be varied and the weights 140 rotatably adjusted to any position on the shaft 134.

Means is provided for retaining the arms 68 and 78 in diametrically aligned relation when adjustment of the counterbalancing weights 140, 145 is effected. A threaded member or screw 154 is carried by the arm 68 and provides a pivot support for a locking tab or member 156 which is movable about the pivot screw 154 to arm-locking and unlocking positions.

When it is desired to maintain the arms 68 and 78 in diametrically aligned radial positions, as illustrated in FIG. 2, the tab or locking member 156 is rotated or swung upwardly to engage a side surface 81 of the arm 78 and thereby prevent swinging or pivotal movement of the secondary arm 78 to the position as shown in FIG. 3. The locking tab or member 156 may be manually rotated on the pivot screw 154 by the operator to arm-locking or unlocking positions.

The relatively movable cover 24 which is preferably fashioned of sheet metal, in the embodiment illustrated in FIGS. 1 and 3, is hingedly or pivotally mounted on the housing 20 by a hinge construction 158. The periphery of the cover 24 is provided with a flanged ledge 160 which, in closed position, engages the upper rim of the housing 20 as shown in FIG. 1. The hinge construction includes a member or component 162 secured to the housing 20 by screws 163. A second member or component 164 of the hinge construction 158 is secured to the cover 24 by screws 165.

The hinge components 162 and 164 are articulately or pivotally connected together. The hinge member or component 164 is fashioned with projecting portions or ears 166 provided with threaded openings accommodating the threaded portions 168 of hinge pins 170. The hinge pins 170 extend into openings in portions 172 of the hinge component 162. In this manner the cover construction 24 is mounted for pivotal movement about the axis of the pivot pins 170.

The hinge component or member 162 secured to the housing 20 is provided with a ledge 176 and a chamber 178. Disposed in the chamber and mounted by the ledge 176 is a switch means 180 which is of conventional construction and is equipped with a switch plunger 182 normally biased outwardly by spring means to an "open" contact position. The switch means 180 is in series with a manually operated switch means 184 of conventional construction, the latter being preferably mounted by the support means or lower housing member 12 as shown in FIG. 1.

The switch means and the motor 40 are connected by conductors L1 and L2 with a conventional current supply for energizing the motor 40. The switch means 184 is manually operated by means of a toggle operating member 186 to open and closed positions for controlling the motor 40. The switch means 180 is provided for automatically interrupting the motor circuit when the cover 24 is moved to open position. The hinge member 164 is provided with a threaded opening receiving a threaded abutment or screw 188 which, when the cover 24 is in housing-closing position, is engaged with the plunger 182 as illustrated in FIG. 1.

The abutment or member 188 is adjusted so that when the cover 24 is in closed position, as shown in FIG. 1, the plunger 182 of the switch means is depressed to close the switch contacts of the switch means 180 to establish an operative circuit to the motor 40 when the switch means 184 is manually moved to circuit closing position.

The abutment or threaded member 188 is adjusted so that when the cover 24 is hingedly moved to an open position, the spring biased switch plunger 182 moves upwardly to open the contacts in the switch means 180 thereby automatically de-energizing the motor 40. This provides a safety factor in that automatic de-energization of the motor 40 interrupts rotation of the components of the centrifugal casting apparatus mounted on the shaft 56 whenever the cover is in an open position.

The cover 24 may be provided with a handle member 192 secured to the cover 24 by means (not shown). The handle member, which is of generally rectangular shape, as illustrated in FIGS. 2 and 3, is provided with a planar portion 194 which is fashioned with a rectangular sight opening 196 in registration with a sight opening 197 in the cover 24. Mounted by the handle member 192 is a closure or member 198 for the sight opening which is slidable relative to the handle member 192 to open and closed positions. The closure or member 198 is illustrated in closed position covering the sight opening 196 in the handle member.

The closure member 198 is provided with a handle or grip portion 200 to facilitate manual slidable movement of the closure member. The closure 198 is in closed position, shown in FIGS. 1, 2 and 3, and is slidable lengthwise of the handle 192 to uncover the sight opening 196. Through the provision of the sight opening 196, the operator is enabled to visually inspect the rotatable components of the casting apparatus without opening the housing cover 24.

The operation of the centrifugal casting apparatus is as follows: In the normal position of the components of the centrifugal casting apparatus, the secondary arm 78 and the assembly of components carried thereby, such as the crucible supporting carriage 96, flask plate 100, flask 110 containing a mold, and the crucible 114 are disposed about an axis at a right angle to the axis of the throwing arm 68, this position of the components being shown in FIG. 3. The secondary arm 78 and the associated components are normally biased to such position by the inclination of the pivot pin 80 with respect to a vertical axis as illustrated in FIG. 4.

Preparatory to carrying on a casting operation, the operator opens the cover or closure 24, places the flask 110 containing the casting mold in the cradle 106 and slidably moves the crucible support carriage 96 so that the crucible plate 119 abuts one end of the flask 110, the other end of the flask abutting or engaging the flask plate 100.

The operator then manually swings the secondary arm 78 and components carried thereby through substantially ninety degrees to the position shown in FIGS. 1 and 2 whereby the secondary arm and components carried thereby are diametrically aligned with the axis of the throwing arm 68. Because of the inclination or angularity of the axis of the pin 80 with respect to a vertical axis A—A, the secondary arm and its associated components normally tend to rotate about the axis of the pin 80 to the position shown in FIG. 3.

In order to temporarily retain the arm 78 and the throwing arm 68 in diametrically aligned relation, the operator manually swings or rotates the tab 156 upwardly about the axis of the screw 154 into a position to engage a side surface 81 of the arm 78 as illustrated in FIG. 2.

The operator then introduces metal to be cast into the chamber 123 of the crucible 114. The metal to be cast may be premelted and poured into the crucible by means of a suitable ladle or pieces of the metal to be cast delivered into the chamber 123 and heat from a blow torch applied to melt the metal in the crucible chamber 123. After the metal to be cast is introduced into the crucible chamber 123, the operator releases the locking nut 71 to a position to allow tilting movement of the arm 68 about the axis of the fulcrum pin 72.

The operator then manually rotates or adjusts the weights 140 and 145 on the threaded shaft 134 until the mass of the arm 68 and the weights 140 and 145 substantially counterbalance the mass of the secondary arm and components of the casting apparatus about the fulcrum pin 72. When such position is attained by adjustment of the weights on the threaded shaft 134, the end weights 140 are drawn up tightly so that all of the weights are held in adjusted balancing position by the arm 68.

The operator then manually swings the tab 156 to its lowermost position, as shown in FIG. 1, thus permitting the secondary arm 78 and the casting components carried thereby to move or rotate about the axis of the pin 80 to the position shown in FIG. 3, viz. normal to or at a right angle to the longitudinal axis of the arm 68. The operator then moves the cover 24 to closed position on the housing 21, this movement causing the abutment or screw 188 to depress the switch plunger 182 to engage the contacts of the switch means 180.

The operator manually moves the switch arm 186 to circuit-closing position which action energizes the motor 40 to rotate the shaft 56 and the arm 68. As the axis of pin 80 is spaced from the axis of the shaft 56, at the start of rotation of the throwing arm 68, the secondary arm 76 and the casting components carried thereby tend, by inertia, to lag behind in a tangential position with respect to the shaft 56, such position being illustrated in FIG. 3.

As rotation of the arm 68 continues and the axis of the pin 80 moves in a circular path about the axis of the pin 56, the secondary arm 78 and the casting components carried thereby are rapidly rotated about the axis of the pin 80 to a diametrically aligned position with the arm 68 as shown in FIGS. 1 and 2.

The centrifugal forces resulting from the rapid accelerated movement of the arm 78 and the casting components associated therewith cause the molten metal in the crucible chamber 123 to rapidly flow through the passage 127 in the rear wall of the crucible and through the slot 125 in the crucible plate 119 into the mold cavity in the flask 110, the centrifugal forces influencing the molten metal to be impelled into the mold cavity.

The rotation of the motor 40 is continued until the molten metal has completely filled the mold cavity and the metal solidified to a dense casting while still under influence of centrifugal forces. The motor 40 is then deenergized by manipulation of the switch member 186 and the rotating casting apparatus brought to rest. The operator swings the cover to open position and removes the flask 110 and the article molded from the molten metal which has solidified before the motor 40 is de-energized. The flask containing the solidified casting may be removed through the use of tongs and the same immersed in water to rapidly dissipate the heat.

If, for any reason, the cover 24 is opened when the motor 40 is operating, the contacts of the switch means 180 are disengaged through upward movement of the switch plunger 182 thus de-energizing the motor. If desired, the viewing port or sight opening 196 may be used for introducing heat to the metal in the crucible without opening the cover 24.

FIG. 7 illustrates a modification of an arrangement for interrupting the operation of the motor wherein the cover construction is completely removable from the housing. In this form, the housing 20' is provided with a member 202 secured to the housing by screws 204. The member 202 mounts a switch means 180' having a plunger 182' which is normally spring biased upwardly to a position opening the contacts of the switch means.

In this form a cover 206, of a configuration similar to the cover 24, is provided with a projection or projecting portion 208 which has a threaded opening accommodating a threaded abutment or member 210. In this arrangement the cover 206 is completely removable from the housing 20'. The threaded member 210 is provided with a locking nut 212. The projection 208 is provided with depending portions 209 which straddle the member 202 to align the abutment or screw 210 with the switch plunger 182'.

In this arrangement the abutment or member 210 is adjusted so that when the cover 206 is in closed position on the housing 20', the member 210 depresses the plunger 182' to establish a circuit to the motor for operating the rotatable components of the casting apparatus. When the cover 206 is removed from the housing 20', the spring biased plunger 182' is moved upwardly to open the contacts of the switch means 180' and thereby interrupt operation of the motor.

It is apparent that, within the scope of the invention, modifications and different arrangements may be made other than as herein disclosed, and the present disclosure is illustrative merely, the invention comprehending all variations thereof.

We claim:

1. Centrifugal casting apparatus including, in combination, a hollow housing having a planar portion and a peripheral wall portion, a hollow base member supporting the housing, a vertically disposed shaft journally mounted for rotation in the housing, an electrically energizable motive means disposed in the hollow base member beneath the planar portion of the housing, means connecting the motive means with the shaft for rotating the shaft, a throwing arm in said housing mounted on and rotatable with the shaft, a secondary arm, a pivot pin pivotally mounting the secondary arm on the throwing arm, casting components including a molding flask and a crucible mounted on said secondary arm, the axis of the pivot pin being angularly disposed with respect to the vertical axis of the rotatable shaft, adjacent surfaces on said throwing arm and said secondary arm being disposed normal to the axis of the pivot pin whereby the secondary arm under the influence of the angularity of the pivot pin is biased for free rotation to a position substantially at a right angle with respect to the longitudinal axis of the throwing arm, and a rotatably adjustable balancing means mounted by the throwing arm, said arms and said casting components being embraced within the peripheral wall portion of the housing.

2. Centrifugal casting apparatus comprising, in combination, a housing member, a shaft journaled for rotation about a vertical axis in the housing member, an electrically energizable motor, means connecting the motor with the shaft to rotate the shaft, a throwing arm in said housing member mounted on and rotatable with the shaft, a secondary arm, a pivot pin pivotally mounting the secondary arm on the throwing arm, said secondary arm supporting casting components including a molding flask and a crucible, the axis of the pivot pin being angularly disposed with respect to the vertical axis of the rotatable shaft, adjacent surfaces on said throwing arm and said secondary arm being disposed normal to the axis of the pivot pin whereby the secondary arm under the influence of the angularity of the pivot pin is normally biased for rotation to a position substantially at a right angle with respect to the longitudinal axis of the throwing arm, said secondary arm being movable to a position in aligned relation with the longitudinal axis of the throwing arm.

3. Centrifugal casting apparatus including, in combination, a housing member, a shaft journaled for rotation about a vertical axis in the housing member, an electrically energizable motor, means connecting the motor with the shaft to rotate the shaft, a throwing arm rotatable with the shaft, a secondary arm, a pivot pin pivotally mounting the secondary arm on the throwing arm, said secondary arm supporting casting components including a molding flask and a crucible, the axis of the pivot pin being angularly disposed with respect to the vertical axis of the rotatable shaft, adjacent surfaces on said throwing arm and said secondary arm being disposed normal to the axis of the pivot pin whereby the secondary arm under the influence of the angularity of the pivot pin is biased for free rotation to a position normally disposed substantially at a right angle with respect to the longitudinal axis of the throwing arm, said throwing arm having threaded means supporting a rotatable body for counterbalancing the secondary arm, molding flask, crucible and casting metal contained therein, and relatively movable means mounted by one arm engageable with the other arm for retaining the secondary arm in aligned relation with the throwing arm during rotatable adjustment of the counterbalancing body.

4. Centrifugal casting apparatus comprising, in combination, a frame construction including a housing member, a shaft rotatable about a vertical axis extending into the housing member, an electrically energizable motor, means connecting the motor with the shaft to rotate the shaft, a throwing arm rotatable with the shaft, a secondary arm, a pivot pin pivotally mounting the secondary arm on the throwing arm, said secondary arm supporting casting components including a molding flask and a crucible, the axis of the pivot pin being angularly disposed with respect to the vertical axis of the rotatable shaft, adjacent surfaces on said throwing arm and said secondary arm being disposed normal to the axis of the pivot pin whereby the secondary arm under the influence of the angularity of the pivot pin is biased for free rotation to a position normally disposed substantially at a right angle with respect to the longitudinal axis of the throwing arm, said secondary arm being movable about the axis of said pin to a position substantially in alignment with the longitudinal axis of the throwing arm, and relatively movable means mounted on one arm and engageable with the other arm for retaining the arms in longitudinally aligned relation.

* * * * *